United States Patent [19]

Roche et al.

[11] Patent Number: 4,636,581

[45] Date of Patent: Jan. 13, 1987

[54] SEALED FLEXIBLE PRINTED WIRING FEEDTHROUGH APPARATUS

[75] Inventors: Thomas A. Roche, Tempe; Robert E. Edminster, Scottsdale, both of Ariz.

[73] Assignee: Motorola, Inc., Schaumburg, Ill.

[21] Appl. No.: 747,749

[22] Filed: Jun. 24, 1985

[51] Int. Cl.[4] ..... H01B 17/30

[52] U.S. Cl. ..... 174/152 R; 29/458; 29/631; 174/23 R

[58] Field of Search ..... 174/18, 23 R, 151, 152 R; 29/631, 458

[56] References Cited

U.S. PATENT DOCUMENTS

| | | | |
|---|---|---|---|
| 3,022,484 | 2/1962 | Thompson, Jr. | 174/152 R X |
| 3,130,260 | 4/1964 | Gray | 174/152 R |
| 3,441,662 | 4/1969 | Augenstein et al. | 174/151 |
| 3,714,012 | 1/1973 | Herron | 174/152 R |
| 3,764,730 | 10/1973 | Malone et al. | 174/151 |
| 3,828,118 | 8/1974 | Bushek et al. | 174/151 X |
| 4,029,893 | 6/1977 | Roger | 174/151 X |
| 4,088,381 | 5/1978 | Harnett | 174/151 X |
| 4,107,456 | 8/1978 | Schuster et al. | 174/151 |
| 4,168,394 | 9/1979 | Yuey | 174/151 |

FOREIGN PATENT DOCUMENTS

| | | | |
|---|---|---|---|
| 200636 | 11/1958 | Austria | 174/76 |
| 0096914 | 12/1983 | European Pat. Off. | 174/151 |
| 950379 | 2/1964 | United Kingdom | 174/151 |
| 1340423 | 12/1973 | United Kingdom | 174/152 R |

*Primary Examiner*—Laramie E. Askin

*Attorney, Agent, or Firm*—Lowell W. Gresham

[57] ABSTRACT

An apparatus which routes electrical conductors through a sealed opening in a wall using a flexible printed wiring cable is disclosed. The apparatus includes a thermoplastic material injection molded around a flexible printed wiring cable. Within the molded object, the cable contains two sections where cable conductors are not enclosed within flexible printed wiring insulation. The two sections are separated by a third section in which cable conductors are enclosed within insulation. The cable additionally contains an increased amount of conductor material where the cable enters and exits the molded object. Two O-rings are contained within the periphery of the molded object.

13 Claims, 3 Drawing Figures

SEALED FLEXIBLE PRINTED WIRING FEEDTHROUGH APPARATUS

STATEMENT OF GOVERNMENT INTEREST

The invention described herein may be manufactured and used by or for the Government for Governmental purposes without the payment of any royalty thereon.

BACKGROUND OF THE INVENTION

This invention relates generally to electrical interconnections. Specifically, the present invention concerns devices which are used in making electrical interconnections between circuitry located on opposing sides of a wall having a sealed opening. In addition, the present invention relates to electrical interconnection devices which utilize flexible printed wiring.

Flexible printed wiring may be made of copper clad Kapton. Kapton is a commonly used insulating material manufactured by DePont made of polyimide plastic. However, flexible printed wiring may use other types of insulating material, such as nylon. Flexible printed wiring exhibits many desirable features. It is easily used in a manufacturing environment, and adapts to wave soldering. Thus, it obviates the need for measuring, cutting, stripping, and hand soldering wires in the making of electrical interconnections. Accordingly, in many situations flexible printed wiring represents a highly desirable alternative to using standard insulated wire cables.

Various feedthrough techniques are known for routing electrical signals through a wall of a sealed container. However, these techniques are generally not readily adaptable to flexible printed wiring cables. One known feedthrough technique utilizes conductive lugs which project beyond opposing sides of a header. The conductive lugs are environmentally sealed within the header, and the header is environmentally sealed within an opening in the housing wall. However, wires must be soldered to the conductive lugs at the opposing sides of the header, then the wires must be prepared and routed to various sources and destinations of electrical signals. Thus, this technique fails to achieve the advantages which can be achieved through the use of flexible printed wiring cables. Furthermore, the soldering required at the conductive lugs heats the header and risks damaging the seal between the conductive lugs and the header. Accordingly, this technique increases the labor, rework, and cost of making the electrical connections between sources and destinations of electrical signals.

Other techniques for achieving a sealed feedthrough utilize a header which contains several parts. Typically, individual wires of a cable reside at predetermined positions within the header, various parts of the header mate together, and then these header parts are clamped together to maintain an environmental seal. While this type of electrical feedthrough provides some of the advantages that may be achieved through using a flexible printed wiring cable, it tends to be overly complicated, and therefore excessively expensive.

SUMMARY OF THE INVENTION

Accordingly, it is an object of the present invention to provide an improved electrical feedthrough apparatus which utilizes a flexible printed wiring cable.

Another object of the present invention concerns providing an electrical feedthrough apparatus which is inexpensive to manufacture and install.

Yet another object of the present invention concerns providing an improved feedthrough apparatus which permits a highly reliable environmental seal with a housing wall through which electrical conductors are routed.

The above and other objects and advantages of the present invention are carried out in one form by a molded object which surrounds three independent sections of a flexible printed wiring cable. Two of the flexible printed wiring cable sections are insulated in a conventional manner, and the third cable section, which separates the other two cable sections, contains exposed conductors without the surrounding insulation. The molded object surrounds the entire exposed section and portions of the two insulated sections.

BRIEF DESCRIPTION OF THE DRAWINGS

A more complete understanding of the present invention may be derived by reference to the detailed description and claims when considered in connection with the accompanying drawings, wherein:

DETAILED DESCRIPTION OF THE PREFERRED EMBODIMENT

Figure 1:
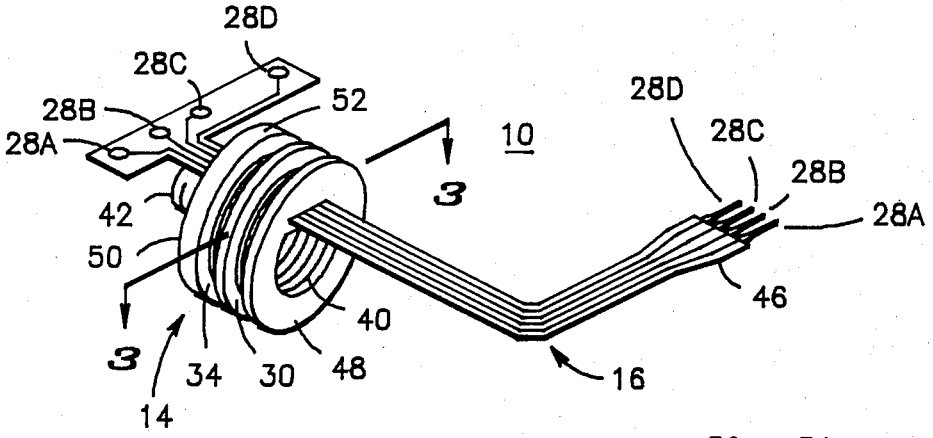
FIG. 1 shows a perspective view of the preferred embodiment of the present invention.

FIG. 1 shows an overview of a feedthrough apparatus 10. Feedthrough apparatus 10 includes a molded object 14 which is made from an injection molded thermoplastic material. More specifically, object 14 is made from a polyphenylene oxide molding compound. The present invention represents a feedthrough having a highly reliable seal. Polyphenylene oxide exhibits a relatively high stability compared to other conventional thermoplastic materials after repeated temperature cycling. Additionally, polyphenylene oxide is electrically non-conductive and capable of sealing the conductors which pass through molded object 14 better than other conventional molding compounds, such as nylon.

In the preferred embodiment, molded object 14 takes the general shape of a cylinder. First and second planar surfaces 48 and 50, respectively, of object 14 have circular shapes. First and second planar surfaces 48 and 50 are parallel, opposing surfaces which are separated by a side 52. In the preferred embodiment planar surfaces 48 and 50 each have a diameter of approximately 0.68 inch. Side 52 spaces planar surfaces 48 and 50 approximately 0.40 inch apart.

Molded object 14 contains an indentation 40 which extends into the interior of molded object 14 from first planar surface 48. Indentation 40 aids the process of molding object 14 by preventing the occurrence of a heavy spot within object 14, which could shrink as object 14 cures causing warpage of object 14. Indentation 40 also provides space for unobstructed placement and movement of objects (not shown) adjacent to molded object 14 in a final assembly.

Additionally, molded object 14 contains a peg 42 located on second planar surface 50, extending perpendicularly away from molded object 14. Peg 42 may be useful in positioning objects (not shown) which are located adjacent to molded object 14 in a final assembly.

Channels 30 and 34 are formed in the periphery of molded object 14. Channels 30 and 34 parallel each other, and reside within side 52 of object 14. As shown in cross-section in FIG. 3, channels 30 and 34 hold O-rings 32 and 36, respectively. The depth of channels 30 and 34 from side 52 into the interior of molded object 14 extends a distance less than the diameter of O-rings 32 and 36.

Figure 3:
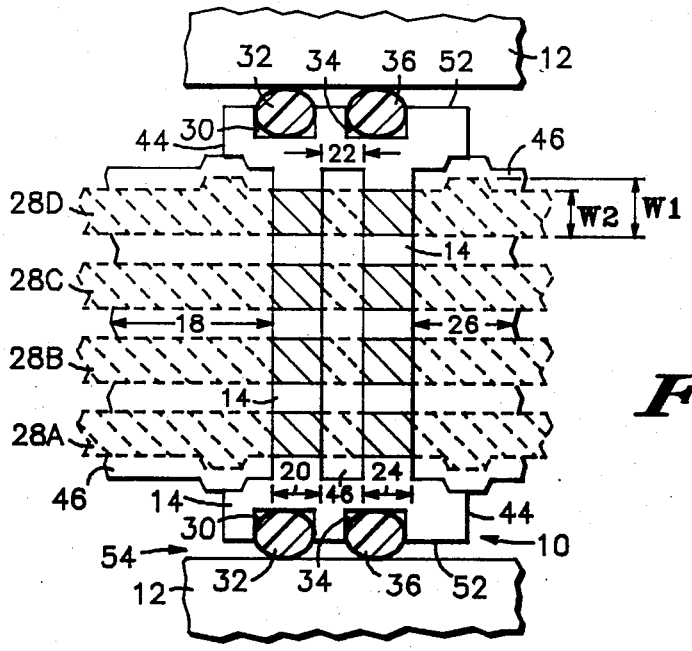
FIG. 3 shows a cross-sectional view of the preferred embodiment from line 3—3 shown in FIG. 1.

Referring to FIG. 3, object 14 is shown clamped in an installed position within an opening 54 in a housing wall 12. O-rings 32 and 36 are compressed between housing wall 12 and molded object 14 and thus form a seal therebetween. In the preferred embodiment, a pressure difference of greater than 15 pounds per square inch can be maintained on either side of housing wall 12 with molded object 14 installed in housing wall opening 54.

Figure 2:
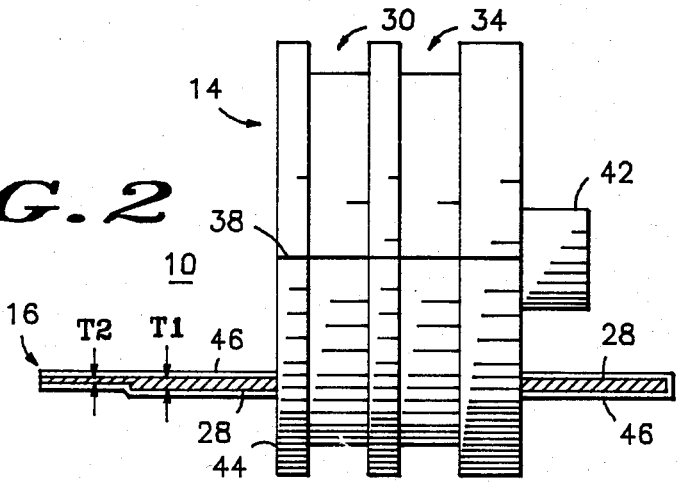
FIG. 2 shows a side view of the present invention.

Referring to FIG. 2, a side view of the preferred embodiment of feedthrough apparatus 10 is shown. As described above, molded object 14 contains parallel channels 30 and 34, and peg 42. Additionally, molded object 14 may exhibit a parting line 38 which incidentally forms during the process of molding object 14. Parting line 38 maintains a minimum height within channels 30 and 34 to insure that the environmental seal is maintained between molded object 14 and housing wall 12, (see FIG. 3). In the preferred embodiment, parting line 38 remains less than 0.001 inch in height within channels 30 and 34. Nevertheless, the existance of two channels and two O-rings provides a redundancy feature which further insures the existence of an effective seal. Accordingly, an excessively high parting line may exist within either one of channels 30 and 34 without harming the quality of the seal between molded object 14 and housing wall 12 (see FIG. 3).

Referring back to FIG. 1, a flexible printed wiring cable 16 enters molded object 14 through first planar surface 48, extends through the interior of molded object 14, and exits molded object 14 through second planar surface 50. As is conventional with flexible printed wiring cables, cable 16 may exhibit a variety of sizes, shapes, and angles so that electrical conductors are conveniently routed between sources and destinations of electrical signals. In the preferred embodiment, cable 16 has a width of approximately 0.25 inch as it passes through molded object 14. Additionally, flexible cable 16 has a thickness of approximately 0.014 inch as it passes through molded object 14.

Flexible cable 16 may contain a plurality of conductors. In the preferred embodiment flexible cable 16 contains end conductor 28A, middle conductors 28B and 28C, and end conductor 28D. Cable 16 routes conductors 28 within cable 16 substantially parallel to each other. Cable 16 electrically isolates conductors 28 from each other by spacing them apart.

In the preferred embodiment each of conductors 28 exhibits a substantially rectangular cross-sectional area and is made from copper. Conductors 28 are exposed on one end of cable 16 for insertion and soldering in a hole of a printed circuit board (not shown). At the other end of cable 16, conductors 28 terminate at a solderpad having a hole therethrough for receiving and soldering an electrical terminal (not shown).

Throughout the majority of cable 16, conductors 28 reside within an insulating skin 46. In the preferred embodiment, insulating skin 46 is made from polyimide (Kapton) plastic. As used herein, insulating skin 46 refers to the polyimide plastic or similar material which encloses conductors 28 throughout the majority of cable 16. Insulating skin 46 does not include molded object 14, even though molded object 14 may also exhibit electrically insulating characteristics. A suitable adhesive bonds conductors 28 to insulating skin 46. Polyimide plastic represents a desirable material from which to construct insulating skin 46 because of its relatively low cost and ability to withstand the heat encountered in wave soldering vats. Thus, polyimide plastic insulation tends to resist deformation and delamination when used with wave soldering.

On the other hand, polyimide plastic exhibits properties which do not readily adapt to molding. For example, thermoplastic materials unreliably adhere to the polyimide plastic insulating skin 46. However, structural adaptations to flexible printed wiring cable 16 greatly improve the adhesion of cable 16 to molded object 14.

Referring to FIG. 3, apparatus 10 is shown installed within opening 54 of housing 12. As discussed above, O-rings 32 and 36, which reside within channels 30 and 34, respectively, of molded object 14, form a tight environmental seal between molded object 14 and housing wall 12 by contacting housing wall 12 throughout an outer surface of O-rings 32 and 36.

An environmental seal is also maintained between molded object 14 and cable 16. In order to insure a reliable seal between cable 16 and molded object 14, cable 16 includes five integrally formed sections. A first insulated section 18 of cable 16 crosses a portion of a boundary 44 between the exterior and interior of molded object 14. The portion of boundary 44 crossed by insulated section 18 occurs at first planar surface 48 (see FIG. 1) of object 14. Insulated section 18 is fully insulated with polyimide plastic insulating skin 46 as discussed above. Insulating skin 46 exists on all sides of each of conductors 28 which are perpendicular to the axial dimension of conductors 28.

An exposed section 20 of cable 16 resides within molded object 14 immediately adjacent to insulated section 18. Exposed section 20 does not contain insulating skin 46. Before the process of molding object 14, conductors 28 within exposed section 20 are exposed and capable of being shorted together. However after molding, the molding compound, such as polyphenylene oxide, exists in all directions which are perpendicular to the axial dimension of conductors 28. In other words, molded object 14 is molded around and between each of exposed conductors 28 within exposed section 20 of cable 16.

An insulated section 22 exists entirely within molded object 14, immediately adjacent to exposed section 20. As with insulated section 18, insulating skin 46 exists in insulated section 22. Exposed section 20 exists between insulated sections 18 and 22.

An exposed section 24 resides entirely inside molded object 14, immediately adjacent to insulated section 22. As with exposed section 20, insulating skin 46 does not exist within exposed section 24. Further, after the molding of object 14, object 14 exists around and between each of exposed conductors 28 within exposed section 24 of cable 16.

Insulated section 26 of cable 16 resides adjacent to exposed section 24. Insulating skin 46 exists within insulated section 26. A portion of insulated section 26 exists within molded object 14, and section 26 crosses boundary 44 at second planar surface 50 (see FIG. 1) of object 14 to extend beyond molded object 14.

Exposed sections 20 and 24 collectively serve two functions. First, the polyphenylene oxide compound readily adheres to conductors 28. Thus, a reliable seal may be maintained between conductors of cable 16 and molded object 14. Second, in exposed sections 20 and 24, no insulating skin 46 exists between conductors 28. Thus during the molding process, molding compound is free to travel between conductors 28. During an injection molding process, molding compound enters a mold cavity (not shown) under pressure. As the molding compound enters the mold cavity, air escapes. Objects inside the mold cavity, such as cable 16, are subject to forces from escaping air and the entering molding compound. The objects may tend to move under the influence of these forces. Thus, the lack of insulating skin 46 between conductors 28 in exposed sections 20 and 24 decreases the surface area against which these forces may act, and resultingly decreases the tendency of cable 16 to move within the mold cavity. In order to insure a reliable seal, cable 16 must not be permitted to travel within the mold cavity and break out within channels 30 and 34, or from side 52 (see FIG. 1) of molded object 14. Thus, the lack of insulating skin 46 in exposed sections 20 and 24 improves the ability to manufacture feedthrough apparatus 10.

In the preferred embodiment, insulated section 22 separates exposed sections 20 and 24. Insulating skin 46 in insulated section 22 tends to hold conductors 28 apart from each other. Resultingly, pressures which are exerted on conductors 28 during the molding of object 14 doe not cause conductors 28 to physically contact one another. Thus, insulated section 22 also improves the ability to reliably manufacture feedthrough apparatus 10 by helping to prevent shorts between conductors 28.

Reinforcement members are added to flexible printed wiring cable 16 to reduce the likelihood of handling damage to feedthrough apparatus 10. One form of a reinforcement member is added to end conductors 28A and 28D of cable 16 as cable 16 crosses boundary 44 of molded object 14. The width of conductors 28A and 28D increases in these locations as shown at W1 in FIG. 3. This width of conductors 28A and 28D is greater than the typical width of conductors 28 throughout the majority of cable 16, shown at W2. Resultingly, the cable is strengthened at boundary 44 of molded object 14 and is less likely to be damaged by the handling of feedthrough apparatus 10.

FIG. 2 shows another form of a reinforcement member. The thickness of conductors 28 varies throughout cable 16 in a manner similar to that described above for the width of end conductors 28A and 28D. Thus, additional material is added to conductors 28 as cable 16 passes through boundary 44 of molded object 14. The resulting thickness of conductors 28 increases as they cross boundary 44 relative to the thickness of conductors 28 at other sections of cable 16, as shown by thicknesses T1 and T2. In the preferred embodiment, thickness T1 of conductors 28 approximates 0.010 inch and thickness T2 approximates 0.004 inch. Each of conductors 28 is stronger in the vicinity of boundary 44 of molded object 14 due to the increased thickness of conductors 28. Thus, feedthrough apparatus 10 is less likely to be damaged by handling, and deflection of the conductors 28 is decreased during the molding cycle.

Many modifications and variations of the present invention are possible in the light of the above teachings. Within the scope of the present invention, the invention may be practiced otherwise than specifically described above. For example, the length, shape, and number of conductors 28 within flexible printed wiring cable 16 may vary widely. Additionally, the thicknesses and widths of conductors 28 need not vary as described herein, but may exhibit an increased strength by exhibiting larger dimensions throughout flexible printed wiring cable 16. Dimensions are presented herein as an aid in teaching the present invention and do not limit its scope. Furthermore, molded object 14 need not have the precise shape or dimensions as described in the preferred embodiment. These changes and others obvious to those skilled in the art come within the scope of the present invention.

What is claimed is:

1. An electrical feedthrough apparatus comprising:

a flexible printed wiring cable having two conductors wherein said two conductors extend through a first insulated section of said cable, a first exposed section of said cable, and a second insulated section of said cable, the first exposed section being between the first and second insulated sections, said cable having a second exposed section and a third insulated section, the second exposed section being between the second and third insulated sections; and a molded object of electrical insulating material surrounding a portion of the first insulated section of said cable, the entire first exposed section of said cable, the entire second insulated section, the entire second exposed section, and a portion of the third insulated section of said cable.

2. A feedthrough apparatus as claimed in claim 1 wherein said molded object comprises a first channel in the periphery thereof, and the apparatus additionally comprises an O-ring located in said first channel.

3. A feedthrough apparatus as claimed in claim 2 wherein said molded object comprises a second channel substantially parallel to said first channel, and the apparatus additionally comprises a second O-ring located in said second channel.

4. A feedthrough apparatus as claimed in claim 1 wherein the first, second and third insulated sections of said flexible wiring cable each comprise an insulating skin made from polyimide plastic.

5. A feedthrough apparatus as claimed in claim 1 wherein said molded object is constructed of polyphenylene oxide.

6. An electrical feedthrough apparatus comprising:

a flexible printed wiring cable having two conductors wherein said two conductors extend through a first insulated section of said cable, an exposed section of said cable, and a second insulated section of said cable, the exposed section being between the first and second insulated sections; and a molded object of electrical insulating material surrounding a portion of the first insulated section of said cable, the entire exposed section of said cable, and at least a portion of the second insulated section of said cable, wherein said molded object exhibits a boundary between an interior and an exterior of said molded object, and the first insulated section of said flexible printed wiring cable contains a reinforcement member where the first insulated section crosses the boundary of said molded object.

7. An electrical feedthrough apparatus comprising:

a flexible printed wiring cable having two conductors wherein said two conductors extend through a first insulated section of said cable, an exposed section of said cable, and a second insulated section of said cable, the exposed section being between the first and second insulated sections; and a molded object of electrical insulating material surrounding a portion of the first insulated section of said cable, the entire exposed section of said cable, and at least a portion of the second insulated section of said cable, wherein said molded object exhibits a boundary between an interior and an exterior of said molded object, the conductors of the first insulated section of said flexible printed wiring cable exhibit a variable thickness and a variable width, and the conductors of the first insulated section of said flexible printed wiring cable having an increased thickness and an increased width at the boundary of said molded object relative to the thickness and width, respectively, of the conductors of the first insulated section in other portions of the first insulated section.

8. A method of routing a plurality of insulated electrical conductors through an opening in a housing wall, the method comprising the steps of:

supplying a flexible printed wiring cable containing a plurality of insulated conductors;

exposing the conductors in a first section of the cable so that the first section resides between two insulated sections of the cable;

exposing the conductors in a second section of the flexible printed wiring cable so that the second section resides between two insulated sections of the cable;

molding an object electrical insulating material around and between each of the exposed conductors in the first and the second sections;

forming a first channel in the periphery of the object;

inserting a first O-ring in the first channel; and clamping the object into the opening in the housing wall so that the O-ring contacts the housing wall throughout an outer surface of the O-ring.

9. A method as claimed in claim 8 additionally comprising the step of reinforcing the flexible printed wiring cable at a boundary between an interior and exterior of the molded object.

10. A method as claimed in claim 8 additionally comprising the steps of:

forming a second channel in the periphery of the object; and inserting a second O-ring in the second channel.

11. An electrical feedthrough apparatus comprising:

a flexible printed wiring cable having two end conductors and at least one middle conductor wherein said conductors extend through a first insulated section of said cable, a first exposed conductor section of said cable, a second insulated section of said cable, a second exposed conductor section of said cable, and a third insulated section of said cable, the exposed conductor sections being between insulated sections, the second insulated section being between exposed sections, and the conductors being surrounded by polyimide plastic insulation only in the insulated sections;

a polyphenylene oxide molded object entirely surrounding the exposed sections and the second insulated section, and surrounding a portion of the first and third insulated sections, said molded object having a boundary between an interior and exterior of said molded object which the first and third sections of said cable cross, and said molded object having first and second channels formed in the periphery thereof;

first and second reinforcement members affixed to the first and third sections, respectively, of said flexible printed wiring cable at positions where the first and third sections cross the boundary of said molded object; and first and second O-rings located within the first and second channels, respectively, of said molded object.

12. A feedthrough apparatus as claimed in claim 11 wherein said first and second reinforcement members comprise an additional amount of conductor material along a width dimension of the two end conductors of said flexible printed wiring cable.

13. A feedthrough apparatus as claimed in claim 12 wherein said first and second reinforcement members each comprise an additional amount of conductor material along a thickness dimension of each of the conductors of said flexible printed wiring cable.

* * * * *